US008800187B2

(12) United States Patent
Peterson

(10) Patent No.: US 8,800,187 B2
(45) Date of Patent: Aug. 12, 2014

(54) SIGN SYSTEM

(75) Inventor: Diane L. Peterson, Frisco, TX (US)

(73) Assignee: Atitania, Ltd., Frisco, TX (US)

( * ) Notice: Subject to any disclaimer, the term of this patent is extended or adjusted under 35 U.S.C. 154(b) by 0 days.

(21) Appl. No.: 13/442,657

(22) Filed: Apr. 9, 2012

(65) Prior Publication Data

US 2013/0099926 A1 Apr. 25, 2013

Related U.S. Application Data

(63) Continuation-in-part of application No. 11/003,708, filed on Dec. 3, 2004, now abandoned.

(51) Int. Cl.
*G09F 7/22* (2006.01)
*G09F 7/18* (2006.01)

(52) U.S. Cl.
CPC ... *G09F 7/22* (2013.01); *G09F 7/18* (2013.01)
USPC ..... 40/611.01

(58) Field of Classification Search
None
See application file for complete search history.

(56) References Cited

U.S. PATENT DOCUMENTS 3,659,365 A * 5/1972 Eaton ..... 40/649
4,763,428 A * 8/1988 Fischer ..... 40/712
4,790,092 A * 12/1988 Farmer ..... 40/607.09
5,640,793 A * 6/1997 Fischer ..... 40/718
5,657,563 A * 8/1997 Lane ..... 40/219
6,647,652 B1 * 11/2003 Seiber et al. ..... 40/606.1
7,376,244 B2 * 5/2008 Baer ..... 382/103
7,559,165 B2 * 7/2009 Wiegel ..... 40/606.03
7,804,403 B2 * 9/2010 Chantelou et al. ..... 340/539.1
7,866,071 B1 * 1/2011 Downey ..... 40/209
2007/0080806 A1 * 4/2007 Lax et al. ..... 340/572.1
2010/0018098 A1 * 1/2010 Xu ..... 40/624
2010/0122481 A1 * 5/2010 Xu ..... 40/602
2011/0012751 A1 * 1/2011 Jones ..... 340/825.69

* cited by examiner

*Primary Examiner* — Charles A Fox
*Assistant Examiner* — Christopher E Veraa
(74) *Attorney, Agent, or Firm* — Thorpe North & Western LLP

(57) ABSTRACT

A method for protecting an advertising sign from weathering conditions is disclosed. The method includes the operation of providing a frame configured to hold a plurality of sign segments, the sign segments having a front side and a back side each configured to carry graphical images. The front and back sides of each sign segment can be covered with a substantially transparent covering configured to enable each sign segment to be essentially undamaged by weathering effects for a period of at least seven years. The plurality of sign segments can be configured to be stacked on top of one another within the frame. The frame can be configured to enable removal and replacement of one or more of the plurality of sign segments.

18 Claims, 8 Drawing Sheets

SIGN SYSTEM

PRIORITY CLAIM

This is a continuation-in-part of U.S. patent application Ser. No. 11/003,708 filed on Dec. 3, 2004.

BACKGROUND

Outdoor and indoor advertising is commonly used to advertise businesses, current events, sales, and other information. Sign systems can range from complex neon signs over one hundred feet tall in Las Vegas to stock paper advertising a yard sale and taped to a phone poll. While there is a well-developed market for complex signs, the lower end market still typically remains a do-it-yourself project.

Current inexpensive signs available on the market can quickly become illegible due to the effects of weather. Even more expensive methods for producing signs, such as screen printing, can look worn in just a few months due to the effects of rain, wind, dust, and ultraviolet light. For small businesses, home businesses, and entrepreneurs, a need remains for signs which can be inexpensively constructed and maintained and which are substantially resistant to the effects of weather.

SUMMARY

A method for protecting an advertising sign from weathering conditions is disclosed. The method includes the operation of providing a frame configured to hold a plurality of sign segments, the sign segments having a front side and a back side each configured to carry graphical images. The front and back sides of each sign segment can be covered with a substantially transparent covering configured to enable each sign segment to be essentially undamaged by weathering effects for a period of years. The plurality of sign segments can be configured to be stacked on top of one another within the frame. The frame can be configured to enable removal and replacement of one or more of the plurality of sign segments.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION

Figure 1A:
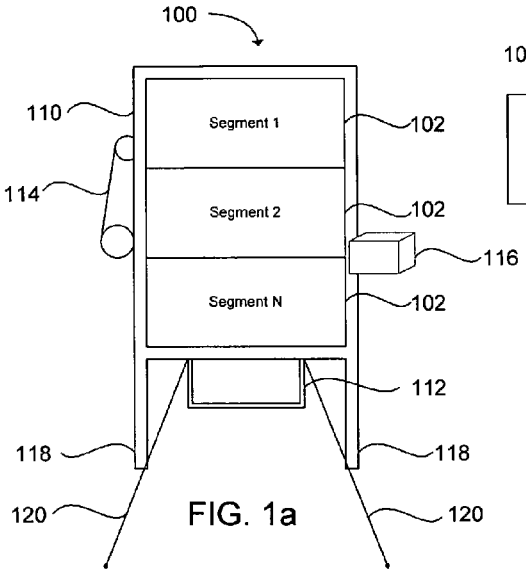
FIG. 1*a* is an illustration of a segmented sign having a weather resistant covering in accordance with an example embodiment of the present invention.

As illustrated in FIG. 1*a*, a segmented sign system 100, in an example implementation in accordance with the invention, is shown. The segmented sign system can comprise a frame 110. The frame can be configured of angle iron, aluminum, plastic, treated wood, or another material capable of carrying a plurality of sign segments in an outdoor environment. The frame can have a coating configured to minimize wear to the frame. For example, a powder coating can be placed on the frame. A sign placement attachment 112 can be coupled to the frame below the sign and configured to enable a person to position a portion of the frame legs 118 within the ground by placing a foot within the sign placement attachment and pushing down on the frame until a portion of the frame legs have been pushed a desired distance into ground. Guide wires 120 can also be connected to the segmented sign system and staked into the ground a predetermined distance from the sign for added stability. The frame legs shown in FIG. 1 are shown as one example and are not meant to be limiting. The segmented sign system can have any number of legs necessary for support and stability. The frame legs can be formed into any shape or size necessary to support the frame and display the sign at the desired height.

In another embodiment, the frame can have a substantially polygonal shape, wherein the frame does not have any legs. In this embodiment, the frame can be mounted on a wall, fence, building, or other surface which will enable the frame to be properly supported. The frame may also be comprised of a flexible material, such as a flexible plastic or rubber material. Flexible frame materials can allow the frame to be configured in virtually any desired shape. The frames may be reused to display a plurality of different signs.

A plurality of sign segments 102 can be stacked within the frame. In FIG. 1*a*, the segments are shown having an essentially equal width and height. However, segments of different height and width are possible, as long as the plurality of segments have an overall height and width capable of being securely held within the frame. In one embodiment, the overall segmented sign system 100 can be quite large. After the sign has been erected, the frame can be designed to be lowered using a pulley system or electric motor to enable replacement of the segmented sign system.

Figure 1B:
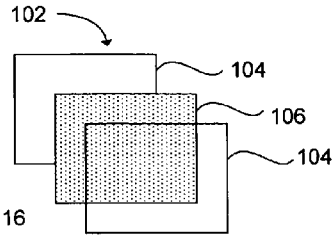
FIG. 1*b* illustrates a sign segment having a first and second weather resistant covering in accordance with an example embodiment of the present invention.
Figure 1C:
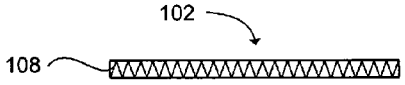
FIG. 1*c* is a side view of a plastic material having an inner corrugation, in accordance with an example embodiment of the present invention.

Each sign segment 102 can be comprised of an inner layer and one or more outer layers. The inner layer can be comprised of a substantially rigid plastic material 106, as shown in FIG. 1*b*. In one embodiment, the plastic material can be comprised of corrugated plastic 108 (or corplast) as shown in FIG. 1*c*. Professional looking graphical and alphanumeric details can be placed on the front and/or back of the plastic material. The graphical and alphanumeric details can be printed in full color. The signs can be printed using a laser printer, screen printing, or another method for placing graphical images upon the plastic material. Colored photographs can be printed on one or more of the sign segments using known printing techniques.

The center layer of the sign can also be created using a vinyl or Mylar which has graphics, photos, or alphanumeric messages. The vinyl can be glued to the transparent protective layers of acrylic or mechanically fastened between the two transparent layers. If the vinyl or Mylar is mechanically fastened between the two layers, this allows the vinyl layer to be replaced when the message on the vinyl or Mylar is desired to be changed. This allows sign owners to recycle or restore the signs if they so desire. For example, the acrylic protective layers can be fastened together (using threaded fasteners, etc.) to hold the vinyl or Mylar that displays the sign message. If desired, a heavy center layer, such as pressed board, can be used to ballast the sign. Using a heavier center layer can offset the lightweight inexpensive materials used for the sign itself.

In addition, this divides the cost of the sign between several layers which can be replaced, recycled or removed. This can be a cost saving to the sign owner over the long run. In addition, each party responsible for a sign segment can directly pay for that sign segment. Another example is where the reusability of the sign allows an owner to divide a cost of manufacturing the sign over the many possible uses (or reuses) of the sign.

In the past, sign costs have not been carried by the individuals who are purchasing the sign. For example, when a real estate agent has purchased a sign for a property, the real estate agent paid for the sign with the real estate agent's own funds. With the present invention, the sign can be divided into sections and each party can be responsible to pay for segments of the signs they are using and for that segment only. For example, a real estate agent may give an owner of a property the opportunity to have a standard sign or the property owner can purchase upgrades to the sign. These upgrades may be based on what standardized layers or segments are available in an upgraded sign. This allows the real estate agent to pay for part of the sign and the property owner to pay for part of the sign. This division also allows the sign cost to be divided by materials in the segments. When there are multiple owners of a sign, each owner can choose different materials for their segment of the sign based on the cost of the material and what the owners want.

A real estate agent can reuse the present invention by replacing segmented components of the sign, which spreads the agent's cost for the sign over many real estate sales. This allows the agent to have customizable sign that is also reusable. For example, each segment can include one or more of the following pieces of real estate information. A real estate sign may include layers or segments for: broker information, agent information, corporation information, seller information, talking/radio sign advertisement information, the presenting agencies information (e.g., multiple listing service IDs), a sponsoring agencies information (e.g., Miracle Network), For Sale notices, For Rent Notices, For Lease notices, property price reduction notices, graphical images, and other real estate related information.

A layer in the present invention is any material that can have message on the layer. The layer can have either one or two sides. If the material is opaque, there is one side that can have a message applied to it. If the material is clear, then the layer has two sides which can have a message applied to it. Multiple transparent layers can be stacked to form the desired sign and message. One or two semi-transparent layers can be used in combination with the transparent layers. The information can be placed upon the sign segment using laser printing, screen printing, decals, imprinting, embossing, impressing or another method for placing graphical images upon the sign segment.

The signs can also use the acrylic or transparent outer layers as a frame which means that the sign will be a frameless acrylic sign. In addition, the sign frame can expand and use inserts to make the frame grow or shrink depending on the number of layers or the size of the layers included in the sign. The sign layers can also be card like where they can be inserted and removed from one or more slots in the frame. There can also be see though windows in layers that would normally be opaque. This allows artwork or messaging from a layer behind another layer to be seen through front layer. This provides peek-a-boo type of windowing in the sign.

The inner layer may also be comprised of a plastic material having magnetic material impregnated therein. The magnetic material can allow magnets and holders to be magnetically coupled to the segmented sign system 100.

The inner layer can be covered on the front and back by one or more outer layers comprising a substantially transparent weather protecting layer 104. The weather protecting layers can comprise acrylic, polyester, Mylar®, Lucite®, glass, or any other material which can allow the sign to be viewed while substantially sealing the sign from the effects of weather. The weather protecting layers can be configured to keep a substantial amount of moisture and dirt from the printed graphical images located on the plastic material. The weather protecting layers can also be formed of a material which will substantially reduce the amount of ultraviolet radiation incident upon the inner plastic material.

Each weather protecting layer 104 can also have graphical and alphanumeric information placed upon it using similar techniques described above. The information can be in color, gray scale, or black and white. The information can be placed upon the weather protecting layer using laser printing, screen printing, decals, or another method for placing graphical images upon the weather protecting material. In another embodiment, the graphical and alphanumeric information may be placed only on the weather protecting layer, leaving the inner substantially rigid plastic material 106 blank. A plurality of weather protecting layers may be coupled to each of the plurality of segments 102, with two or more of the weather protecting layers containing graphical information. For example, a first weather protecting layer may contain alphanumeric information about a sale. A second weather protecting layer may contain graphical information, such as seasonal or holiday graphical images. The second weather protecting layer can be removed and replaced with updated seasonal or holiday graphical images as the seasons change.

Another benefit of the present invention is that it allows signs to be divided into parts where one part of the sign contains "stable" data and graphics that will not be changed frequently. Other parts or segments of the sign can be used for portions of the data that are likely to be modified more frequently. For example, a segment of the sign can contain a real estate agent's cell phone number that might change often or a holiday name that changes each month. Accordingly, changes can be made to the sign without replacing the entire sign. Segmenting the data reduces the cost of the sign and the cost of reusing the sign.

The center layer plastic or corplast material can also be formed into multiple shapes for the sign and the message placed on the sign. The plastic, corplast, or thin vinyl can be cut by a laser or cut by a C-router. Then the protective acrylic layers can be placed over the center section. The protective layers may or may not be cut into the same shape as the center layer.

The graphical and alphanumeric information placed upon the weather protecting layer 104 and/or the inner layer can be cut out using a laser. A piece of flexible plastic material having an adhesive backing can be placed over the weather protecting layer or inner layer. A laser can be used to cut out one or more desired graphical or alphanumeric shapes from a desired position in the piece of flexible plastic material. The remaining flexible plastic material having an adhesive backing can then be removed, allowing the one or more cutout shapes to remain on the weather protecting and/or inner layers at the desired position.

Cutting the shapes out from the flexible plastic material while it is adhered to the weather protecting and/or inner layers can allow the graphical and alphanumeric information to be accurately placed upon the sign segments. Using a laser to cut the graphical and alphanumeric information after the adhesive vinyl or Mylar has been placed on the sign segment can eliminate a step of having to place the cutout information in a proper position after it has been cutout. In addition, vinyl layering can take place by applying a second layer of adhesive vinyl or Mylar over a first layer and then using a laser to cut the vinyl into the desired decal shape. Then the surrounding waste material can be removed and this leaves the decal as a second layer over the first layer. The laser can be used at a relatively low power so that the first decal layer is not damaged. Any number of layers for graphics and lettering can be created using the fast and effective method. In addition, a decal or vinyl line or control line can be used to guide the decal application and determine if vinyl graphics are being appropriately aligned on the layer surface. This decal or vinyl line can be included in the electronic template used to create the decal in order to speed the process of aligning the decal text and images.

In one embodiment the weather protecting layer can comprise a single piece of plastic material. The plastic material can be wrapped around a sign segment 102 and secured. The plastic material may have a composition allowing it to shrink when heated or exposed to ultraviolet radiation. Shrinking the plastic material can enable the material to tightly bind around the sign segment, allowing the plastic material to be nearly invisible. The plastic material may also be printed with graphical information comprising an advertisement prior to the plastic material being wrapped around the sign segment. The pre-printed plastic material can be wrapped around the sign segment and secured in such a fashion that the printed graphical information will be visible.

Each segment 102 can contain at least one piece of information. For example, one segment can contain a company's name. Another segment can contain a company's address. A third segment can contain a company's logo. A fourth segment may contain variable advertising, such as an advertisement for a monthly special. One or more segments may also be left blank. The blank segments may be used as filler to ensure the sign segments fit properly within the frame 110.

Each sign segment 102 can be independently added to or removed from the segmented sign system. For example, one segment may contain a business's phone number and contact information. If a business moves or changes phone numbers, the segment containing the contact information can be removed and replaced with a segment containing the updated information. Segments containing advertisements can also be added and removed, allowing small businesses to continuously update their sign while maintaining its professional appearance. Segments can be removed and have new or different graphical and alphanumeric information placed upon them. For example, as the seasons and holidays change, updated seasonal and/or holiday graphical images can be placed upon the sign segments. Two or more parties can produce a sign together, with each party paying for the sign segments they desire. The plurality of sign segments can be rearranged to fit the changing needs of the sign's owner.

Another type of sign that can be produced using the following method is a yard calendar. The yard calendar may have the name of the individuals or family living at the residence where the yard calendar is to be installed. The yard calendar may also include the street address of the residence or business, artwork, seasonal greetings, a philosophical quote, political support slogans, and other related yard calendar information.

For example, one layer of the sign may include graphics for certain months such as Halloween, Christmas, or New Year's decorations. Another layer of the sign can include the month name and a dated calendar. Alternatively, a seasonal calendar can be provided such as spring, summer, winter and fall. Thus, the layers can be changed but the same sign frame and background layers can be used with the changeable layers. In the past, there have not been any holiday yard signs or yard calendars that have changeable layers or segments. The present invention provides a single frame or design that can be used with interchangeable backgrounds, calendars, graphics and similar sign elements. Since calendars repeat periodically, a number of date calendars can be provided that can be reused periodically in the yard sign.

The segmentation of the signs of the present invention when combined with the reusable frames allows the sign owners to invest in valuable framing for the signs while using less expensive reusable information segments. In particular, segmented sign frames enable the reusable signs to be used by sign owners more effectively. Sign owners can customize the number of frames and the organization of segments which they desire. In addition, the layering of multiple types of materials and the use of multiple sign processes allows less expensive sign materials to be used while still protecting the sign messages from the elements and weather.

Reusability of the signs is valuable aspect of the present invention. In the past, sign makers may have moved a sign from one location to another but sign makers have generally not allowed a weather protected segment to be removed and then replaced with a new message. In addition, sign makers have generally used one type of material to manufacture signs and have not layered their materials. Manufacturers generally use just wood, plastic or metal without combining any layers of materials or processes to make the sign less expensive and recyclable.

Each sign segment can be comprised of different material. For example, one segment may be comprised of the plastic material having magnetic material impregnated therein. Having one sign made of the magnetic material can reduce the overall costs of the sign while enabling external magnetic material to be coupled to the one segment. Each sign segment can have a serial number engraved in order to keep track of the sign segment's materials and construction. This tracking system can enable the segments to be easily replaced. The serial numbers may also enable the segments to be traceable if the segments are stolen.

A strong but inexpensive material can be used as a backing for thin vinyl and Mylar layers. Then the vinyl can be applied to the strong backing such as a clear or opaque vinyl. Then another of clean acrylic or plastic can be applied over the message on the vinyl or Mylar and this will protect the sign message. Multiple clear layers can be arranged to give the sign a feeling of depth for the messages that are printed on any or all of the clear layers.

A public enclosure 114 can be coupled to the frame 110 and used to store information which can be accessed by the public. The public enclosure may comprise a clear container having a lid. The lid can be used to keep the information safe from environmental damage. The clear container can enable the public to see the information stored within the public enclosure. For example, a home owner may use the segmented sign system 100 make a "for rent" or "for sale" sign. The public enclosure can be used to store flyers having more detailed information about the house or rental property, such as pictures of the interior, specifications, sale or rental information, and the like. Persons who are interested in the property can take remove a flyer from the public enclosure.

A private enclosure 116 can be coupled to the frame 110 and used to store information which can only be accessed by persons having permission. The private enclosure may include a keyed entry system, allowing a person having a key to open the private enclosure. The private enclosure can be used to store valuable contents which the sign owner does not want the public to access. For example, a realtor may place a key to a house within the private enclosure. It can also be used for a radio transmitter used to transmit information about a house, rental property, sale, or the like. A battery system can be located within the private enclosure and used to power a plurality of illumination sources, such as LEDs, located on the segmented sign system 100. One or more of the illumination sources can be located either within the frame or outside the frame. The one or more illumination sources can be configured to illuminate one or more of the plurality of sign segments 102. The battery system can be recharged using a solar power electrical source located on the exterior of the frame.

Environmental controls can be incorporated within the segmented sign system 100. For example, a fan or dehumidifier can be used to control humidity between layers of the sign. Alternatively, a sealant can be used to enable the segmented sign system to be substantially sealed to the external environment.

The segmented sign system can enable signs having a professional appearance to be produced at a reasonable cost. A small business owner can use the same sign for a variety of different circumstances by swapping out different sign segments. For example, a realtor can produce a sign having personal information, contact information, and specific information about the property for sale. When the property is sold the sign can be reused at a new property by replacing the sign segment having specific information about the property. The segmented sign system can significantly reduce the amount of money small business owners spend to advertise. Using the segmented sign system, small business owners can advertise more often for a larger number of different occasions, helping them to increase the public's knowledge and, more importantly, increase sales.

The signs discussed herein can also be used for yard sale signs, real estate signs, political campaigning, and similar uses. In the example of political campaigns, the segments can contain the candidate names, party, platform, political office, the election year, election date, graphics, indicia regarding re-election, and similar information. The layering and/or sectioning can be used in a component fashion. For example, the first layer may be a blue field with white stars on it. The second clear layer may include the candidates name and the third layer may include the party name. This allows the artwork and other information to be re-used. When a candidate is going for re-election the same artwork and name layer can be used and just one layer can be replaced.

The layering allows the sign frames, letter layers and artwork layers to be leased to customers and then the customer can purchase a layer that includes the modified message and/or graphics. This applies to real estate signs, rental signs, campaign signs, and other signs that can be reused. Not only does this reduce the costs of signs but it allows the signs to be more effectively recycled, restored or refurbished. Being able to reuse and recycle sign components also protects the environment because less overall waste is created. In the past, purchasers of signs have discarded entire signs because they are no longer useable. The present invention helps overcome this problem of signs that are discarded after just one use.

In addition to leasing portions of the sign and selling other portions of a sign, an entire completed sign can be leased. Fully assembled signs can be leased to individuals who desire a sign that does not need any changes. For example, a pre-assembled sign can include the elements of a "Grand Opening", Seasonal Sale, or similar generic signs. If the customer leasing the sign desires to customize the sign, then additional layers can be added to the sign in order to make changes to the sign.

Not only can the sign frame and components be leased but space on the sign or layers with certain messages can be leased. For example, if a sign owner has a permanent sign in a good advertising location, then segments of the sign can be replaced with new updated advertising segments. This allows the layers of the segments to be updated with advertising material and the sign owner can lease either layers or segments of the sign.

Another example of leasing is where the customer leases a layer with a pre-printed message such as "[blank] Acres for Sale" and another purchased clear layer can contain the number of acres "99" printed on it. When the two layers are combined, it will read as "99 acres for sale". This is possible because of the template produced to match up the leased and customized parts of the messages. When the customer has sold the property, then customer can return the leased message and another customer can purchase a layer with a different number acres to be sold. This also system and method also applies to graphics or photos.

A software management system can accompany the present signing system and method. The software can manage the identification tracking numbers on the signs. These identification tracking numbers are used to drive the leasing and re-furbishing program. In addition, the tracking number can be used to track theft of the signs. When the sign are leased, a reward sticker can be placed on the signs to indicate that a reward will be paid for individuals who return stolen or lost signs. Another feature of the software can manage the leasing inventory including the sign frames, the leasing terms and the sign segments that are rentable or leasable. A Global Positioning System (GPS) tracking device can also be used with the sign to deter the theft of expensive signs or leased signs.

The layering described for the present invention can be setup in any number of layers. Only the sign frame or attachments to frame may limit the number of layers. Further, the present invention can use N layers by M segments as desired by the purchaser of the sign. Although the example of the sign in the drawings illustrates the segments being stacked in a vertical fashion, the segments may also be created in a horizontal direction or in a two-dimensional irregular grid.

The implementation of reusable signs in the present invention also allows old signs to be consigned to a sign shop for refurbishing and/or resale. The reusable frames and many of the reusable components such as the frames, artwork, sections, and layers can be re-sold, traded, pawned, sold for refurbishing, or otherwise sold.

Because these signs can be recycled or refurbished, this allows standard sizing to be developed for the signs. When standard frame sizing is used, then standard layers sizes can be generated for the signs. The standardization of the sign layers can reduce the cost of the overall sign because sign purchasers can enter a sign shop and buy a number of pre-produced layers with graphics and backgrounds. Then these standardized layers can be used with customized layers to produce less expensive but useful signs.

Standard sign sizing also results in efficiencies in generating the signs and cost standardization. Computer templates can be used that are set to the standard frame and sign sizes. When a customer desires to have a new sign to be manufactured then the customer can select a template to be used. This template can be used to generate the graphics, lettering and other indicia on the sign. For example, the sign can be generated with the templates using laser etching, engraving, or silk screening. Each template can be assigned a cost and this provides a uniform cost for the sign generation. These templates can be used to provide any layer or segment of the signs. Using a sign template reduces the setup and labor costs associated with producing the sign.

Another valuable aspect of the present invention is that the invention combines mass-assembly techniques with customizations that are typically needed in so many signs. Because the present invention can pre-fabricate many of the sign parts, this reduces the overall sign cost. Then the end customer can customize just one or two layers that are needed and only pay for that customization while retaining the cost reductions of the mass-produced items.

For instance, signs can be manufactured in a number of standardized configurations that include a pre-determined number of legs, standard finishes and sealants, sign segments or sections, and the frame will be preconfigured to hold 1-N sign layers. As discussed above, the sign layers can be acrylic, corplast, and similar materials. The layers can be fastened into the frame with metal or plastic fasteners. The frame, layers and printed materials can be standardized as far as possible to obtain the benefits of economy of scale. In addition, these frames can have standardized locations for the adding of sign accessories. These accessories are similar to those as described before such as talking sign attachments, lights, motors, etc. Since the signs of the present invention are less expensive than entirely custom produced signs, this allows the customer to purchase more accessories.

This combination of pre-assembled signs allows a customer to pick a sign from the a showroom and then immediately combine their own customized elements with the pre-made elements.

The present invention can also be used to enhance billboard signs. Current billboard signs are printed one time and then fixed to the billboard. After this one time printing the billboard cannot be modified without removing the entire printed sign. The present invention provides a segmented sign that can use an attached motor to bring down a section of a billboard sign and replace it. This allows the owner of the sign to change prices, merchandise volume amounts or any other information contained on the sign.

In another embodiment of the sign, a drainage system can be provided for the segmented sign. The drainage system can include a drainage channel that is in or on the sign to drain away excess rain or other moisture. A drainage pipe can be connected to the drainage channel through the sign's frame. The drainage pipe can also be configured to support the segmented sign in the ground. In addition, a receiving base can be provided that is configured to be mounted into the ground. In other words the receiving base can be a cement block that is set into the ground or the receiving base can be a metal sleeve that is cemented into the ground. The receiving base can receive the drainage pipe and include a drain to allow water to pass from the drainage pipe to the ground. A layer of gravel can located under the concrete for the water to drain into from the sign. This drainage system keeps the sign dry and can also avoid the rotting or water damage that has existed with wood and other signs.

A metal loop can be located on the segmented sign frame or drainage pipe and another metal loop can be located on the receiving base to enable the segmented sign to be locked to the receiving base. If the sign is not locked in place then vandals may be able to remove the sign from the drainage system. The drainage system can double as a removable sign base. In other words, the signs can be interchanged at the same site using minimal installation procedures once the receiving base has been installed. Alternatively, the drainage pipe can be welded to the metal sleeve into which the drainage pipe is mounted.

Figure 2:
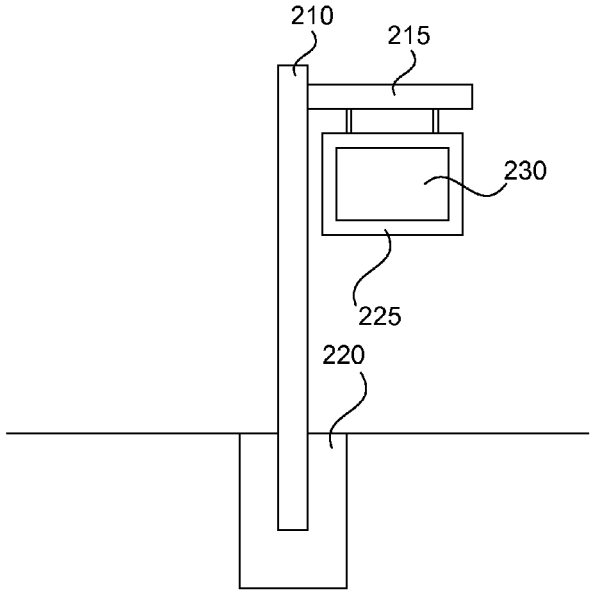
FIG. 2 is a front view of a sign system in accordance with an embodiment of the present invention.
Figure 3A:
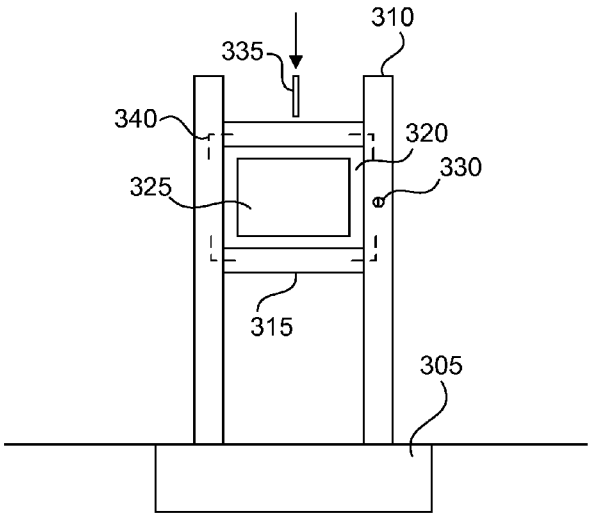
FIG. 3*a* is a front view of a locking sign system in accordance with an embodiment of the present invention.

Referring to FIG. 2, an example implementation of a sign system is illustrated where a post is inserted into the receiving base to support the sign system. The receiving base 220 can act as an anchor to anchor the sign in position. The sign can be permanently fixed within the receiving base, such as with the use of a cement receiving base, for example. Any of a variety of materials may be used for a receiving base to which the sign system is permanently or removably attached. For example, the receiving base may be made from rubber, composite, and/or metal materials. Whether permanently or removably attached to the receiving base, the post can be configured to extend within the receiving base as shown, or may be coupled to the receiving base on a top of the receiving base without extending into the receiving base (as illustrated in FIG. 3*a*). In examples where the sign is removably, or non-permanently, affixed to the receiving base, the receiving base may comprise a void for receiving the post and/or a coupling device configured to couple the post to the receiving base. A lock may be used, for example, to couple the post to the receiving base. Any of a variety of suitable mechanical devices may be used alternately or in combination with the lock, such as screws, bolts, and so forth.

The receiving base may comprise any suitable shape or size. For example, the receiving base may be cube-shaped, cylindrical, spherical, or any other suitable shape. The receiving base may be configured to receive and support a plurality of signs. The receiving base can be hollow or solid. The receiving base can be painted as desired to change the appearance and suit a particular application. The receiving base can be formed with a plurality of levels, such as with a step-like shape, as desired for particular applications. The receiving base can include a power supply and any of a variety of other devices configured to be powered by the power supply. For example, when used at a construction site the sign system may desirably include a weather ban radio powered by the power supply. The sign system can further include electrical lighting powered by the power supply. For example, the electrical lightning can be on or in the receiving base, or attached to the post or any other suitable part of the sign system.

The sign system can include a frame 210, 215, and/or 225 and one or more sign segments 230 insertable into or supportable by the frame. In this example, the frame 225 is not rigidly attached to a cross-bar supported by the post. Thus, the frame can sway or move when acted upon by wind or other forces. In other embodiments, the frame can be rigidly affixed to the post and/or cross-bar.

The sign segment can be a static or dynamic display. As a non-limiting example of a static display, the sign segment may be a printed advertisement. As a non-limiting example of a dynamic display, the sign segment can include an LCD display screen. The one or more sign segments can be interchangeable with other sign segments. For example, if a first sign segment is a for sale advertisement, the first sign segment may be replaced at some point by a sign including an address of the property, such as after the property has sold.

Figure 3B:
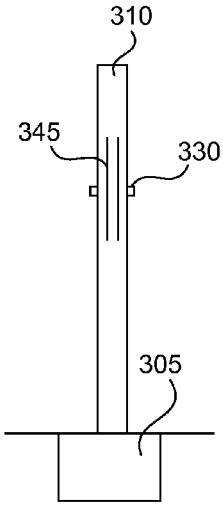
FIG. 3*b* is a side view of a locking sign system in accordance with an embodiment of the present invention.

Referring now to FIGS. 3*a*-3*b*, the sign system can include multiple posts 310 supported by the receiving base 305 and configured to support the frame 320 and sign segment 325 there-between. In some examples the posts and/or any cross-bars 315 may comprise the frame. In other examples the posts and/or cross-bars may form a receiving area for a frame 320 into which one or more sign segments are inserted. FIG. 3*b* illustrates a plurality of slots in a side of a post for receiving multiple sign segments at different positions within the frame. Although shown here in the side of the frame, a slot can also be in the front, top, back, or bottom of the frame as well. The slot can be a permanent slit, or can be formed by opening a portion of the frame such as by sliding, pulling, or pushing a portion of the frame into a different position.

The sign system of FIGS. 3*a*-3*b* includes various protection mechanisms. For example, the system can include a lock 330 on the frame configured to extend through at least a portion of the frame through an aperture in a locked position to prevent the sign segment from moving out of the slot. The lock may comprise a simple pin inserted through the frame, or may comprise a bolt, keyed lock, or any other suitable device. As shown in FIG. 3*a*, the lock may comprise a pin 335 which is insertable through the frame and at least partially into the sign segment.

The posts and/or cross-beams, which together may comprise the frame in some examples, can be electrically wired 340 or wirelessly coupled to one another. With the different parts of the sign system being in electrical or wireless communication with one another, the sign system can detect whether a change in a configuration of the sign system has occurred, or more specifically can detect whether the sign is still intact. For example, if someone attempts to dismantle the sign for theft, the sign system can detect the dismantling and activate a local or remote alarm. The change in the configuration of the frame can be detected by a detector and may comprise a disruption of an electrical connection between at least two of the frame members or may comprise a disruption of wireless communication with one or more of the frame members. The frame can include frame a label and warning system to warn that opening, dismantling, or otherwise tampering with the frame constitutes a breach of warranty and/or that tampering with sensors in the sign system is a breach of warranty.

The sign system can include any of a variety of types of sensors. For example, the sign system can include a sensor to detect when the frame has been opened to access the sign segment. When the sign system includes a tube, box, or other holder of fliers or other materials for distribution, a sensor can be included to detect when the supply of materials for distribution have been depleted to a certain point or completely disbursed. When the sign system includes a printer for printing materials for distribution, sensors can be included for identifying when the ink or paper is low and/or completely used. The sign system can include sensors to detect temperature, humidity, movement near the sign and/or movement of the sign, wind, moisture in the frame or on the sign segment, etc. Another sensor that may be included is a camera for capturing images near the sign system. Another type of sensor may be a scanner, such as for scanning driver's licenses of realtors visiting a home to show the home to prospective buyers. In one aspect, the sign system can include a sensor for detecting a speed of vehicles passing the sign, similar to radar used by law enforcement. The speed of the vehicles can be monitored and sent to state authorities or to law enforcement, along with any relevant images captured by the camera. In essence, the sign system can include many different types of sensors configured to monitor a multitude of aspects of the sign system, the environment around the sign system, and so forth. Data collected by the sensors can be stored locally at the sign and/or transmitted to a remote user computing device.

Each portion of the sign system, including portions of the frame, the sign segments, and so forth, can be assigned a unique identification number. The unique identification number can be permanently or temporarily affixed to each portion of the sign system and/or may be detectable visibly and/or with a scanner, such as an optical, radio frequency, or other type of scanner. An address of the property can be associated with the unique identification numbers of the sign system. The unique identification numbers, addresses, and so forth for sign systems can be stored in a database for tracking and monitoring the signs.

Reference will now be made to FIGS. 4*a*-4*d*. A sign system in accordance with an example of the present technology can include a frame 420 comprising a one or more frame members configured to support a sign segment 425. The sign system can include a detector 440 in the frame and in communication with the plurality of frame members and configured to detect a change in a configuration of the frame. Unless otherwise specifically designated, the frame may comprise the post, any cross-beam or other sign segment support member, and/or any sub-frames (i.e., 320 in FIG. 3*a*) supported by the post and/or cross-beam and specifically configured to receive one or more sign segments. In some examples, unless specifically designated, the sign segment may comprise one or more sign segments supported by the frame and may also be considered to include the sub-frame. In one aspect, the frame 420 may be considered an external frame configured to support one or more sub-frames as internal frames, each of the internal frames being configured to support one or more sign segments.

In one aspect, the detector in the sign system can include at least one of a global positioning system (GPS) device, a radio frequency device, and an accelerometer and is configured to detect movement of at least one of the plurality of frame members. The detector can include a camera and a processor 445, the camera being configured to identify a normal state of the plurality of frame members and a current state of the plurality of frame members. The processor can be configured to compare the normal state and the current state to determine whether there is a change in the configuration of the frame.

The sign system can include a transmitter supported by the frame and configured to transmit a signal to a user when changes in the configuration of the frame are detected. For example, a text message, voice message, email, or any other suitable alert may be transmitted to the user. The transmitter may preferably be a wireless transmitter, but can also be a wired transmitter.

The sign system can also include a sensor 440 supported by the frame and configured to detect wind blowing against at least one of the frame and the sign segment. The transmitter can be further configured to transmit an alert to a user when a force of the wind is greater than a predetermined amount, as detected by the sensor. The frame can include a protection mechanism for protecting the at least one of the frame and the sign segment from the wind with the force greater than the predetermined amount.

Figure 4A:
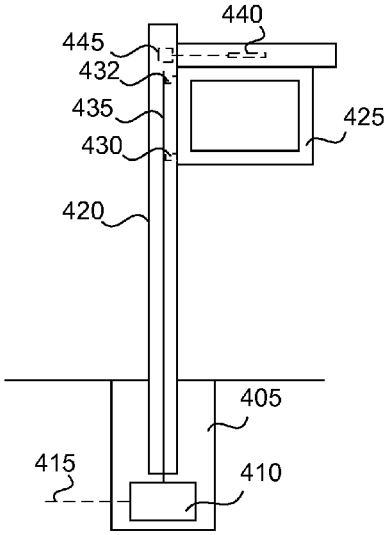
FIGS. 4*a*-4*b* are front views of sign systems with moving or pivoting portions in accordance with embodiments of the present invention.
Figure 4B:
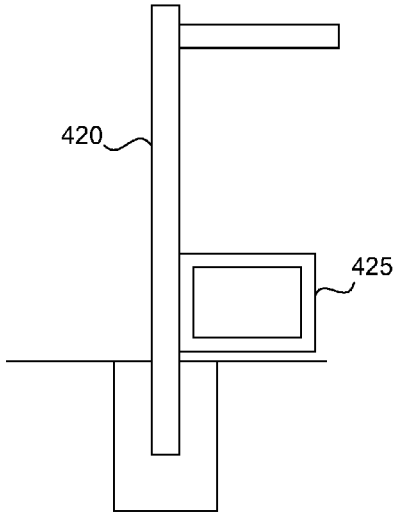
Figure 4C:
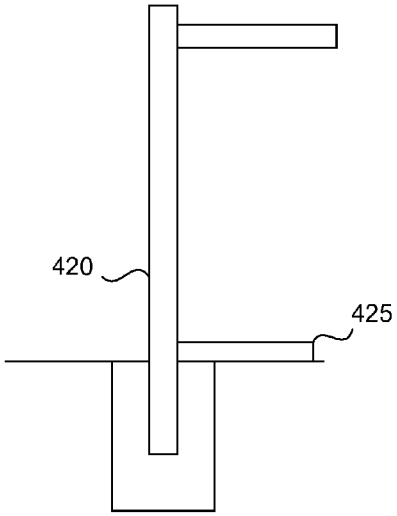

The protection mechanism in some embodiments can include a sign segment release 430 for releasing the sign segment from an upper portion, or cross-beam, of the frame. The frame can have a slot 450 along a side thereof (see FIG. 4*d*) to enable the sign segment to slide vertically along the frame between the upper portion of the frame and a lower portion of the frame when the sign segment is released, as shown in FIG. 4*b*. The sign system can further include a secondary sign segment release 432 for releasing a portion of the sign segment from the slot in the frame to enable rotation of the sign segment from a substantially vertical orientation to a substantially horizontal orientation, as shown in FIG. 4*c*. This configuration can reduce a surface area of the frame system exposed to the wind and can thus reduce a likelihood of damage to the sign system. In another example configuration, rather than rotating the sign segment from the vertical to horizontal orientation, the sign segment can be lowered into the ground, at least partially within the receiving base 405.

Figure 4D:
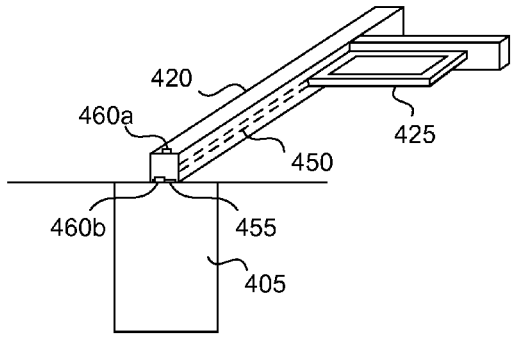

As shown in FIG. 4*d*, the frame 420 (or post in this example) can be released from the receiving base, at least on one side, and pivoted to rest against the ground. The frame can be hingedly attached to the receiving base with a hinge 455. A locking device can include a first portion 460*a* on the post and a second portion 460*b* on the receiving base to lock the frame/post in an upright position.

Movement and/or rotation of the sign segment, and/or pivoting of the frame can be performed manually, or may be performed mechanically, locally or remotely. FIG. 4*a* illustrates an example configuration where a motor 410 is included in the receiving base with a drive belt 435 or the like for manipulating the sign segment. A power supply can be included within the receiving base, or alternately the motor and any other electrical devices in the sign system can be powered by a connected power cable 415.

Figure 5A:
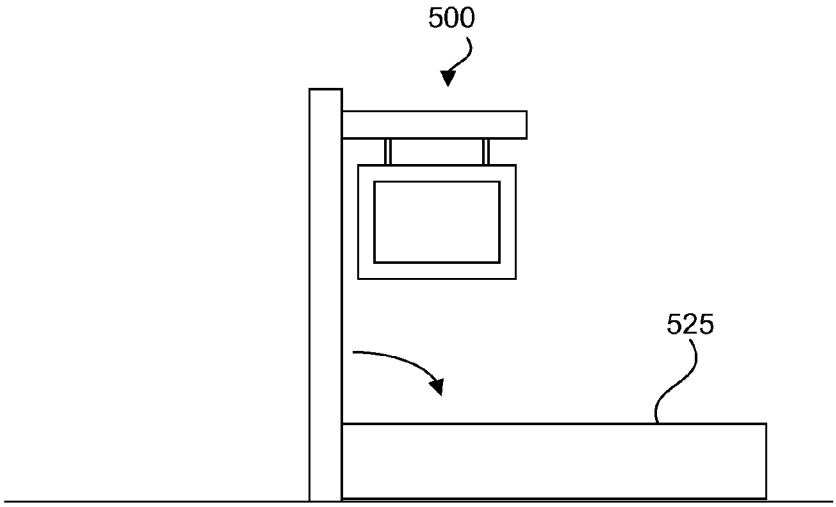
FIGS. 5*a*-5*c* are front views of sign systems include an enclosure and a shield respectively in accordance with embodiments of the present invention.
Figure 5B:
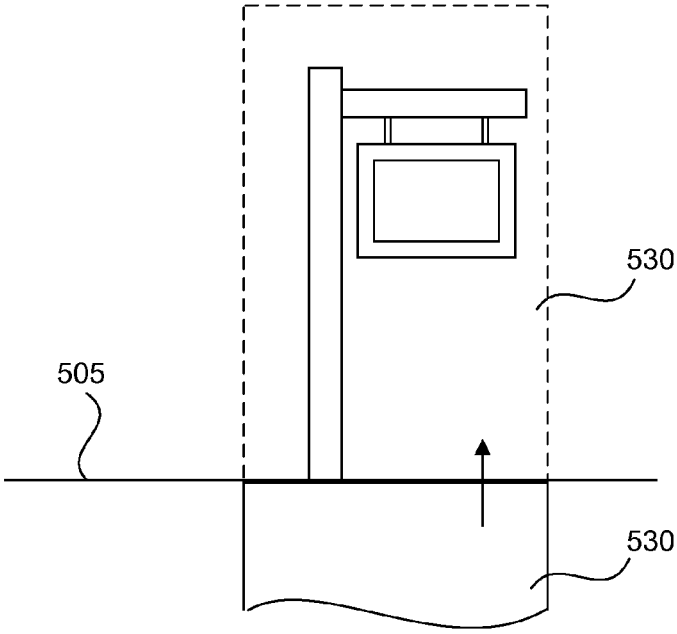
Figure 5C:
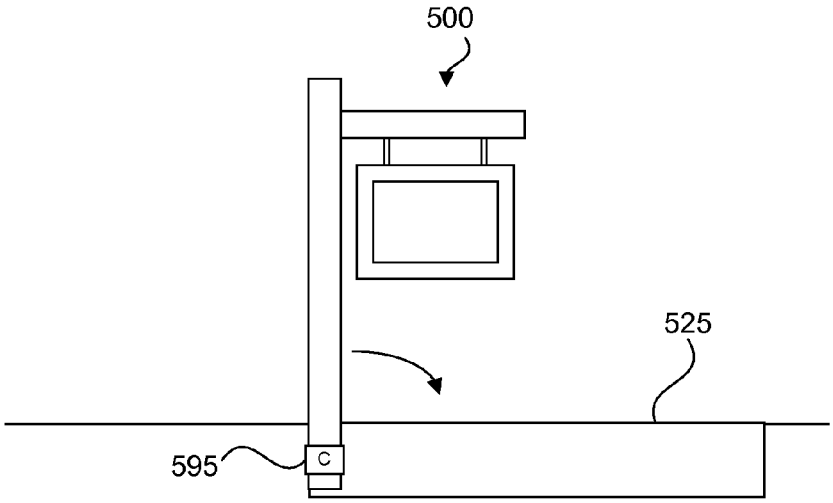

Referring to FIGS. 5*a*-5*b*, the protection mechanism can include any of a variety of types of protection mechanisms, such as a shield, cover, enclosure, etc. Again, the protection mechanism can be manually operatable by a user, locally activable by a user, remotely activatable by a user via a computing device, and automatically activated when the alert is transmitted to the user. FIG. 5*a* illustrates an example configuration where the protection mechanism comprises an enclosure 525 and the sign system 500 is pivoted downward into the enclosure. FIG. 5*b* illustrates an example where a shield 530 or cover is raised from within the ground 505 in front of or around the sign system. A shield or cover may be moved into a shielding or covering position from any suitable location relative to the frame and sign segment, depending on the application. For example, if there is an overhang of a building, the shield or cover can be lowered from the overhang. In another example, the shield or cover may come out of a hidden position in a wall of a building adjacent to the sign system to shield or cover the sign system. In another example not illustrated, the sign system can be lowered into an enclosure within the ground, such as by lowering straight down or by pivoting the sign into the enclosure, as illustrated in FIG. 5*c*. A computing device 595 as used with these signs may be located below ground to protect the computing device, smart phone or cell phone from weather and theft.

Figure 6A:
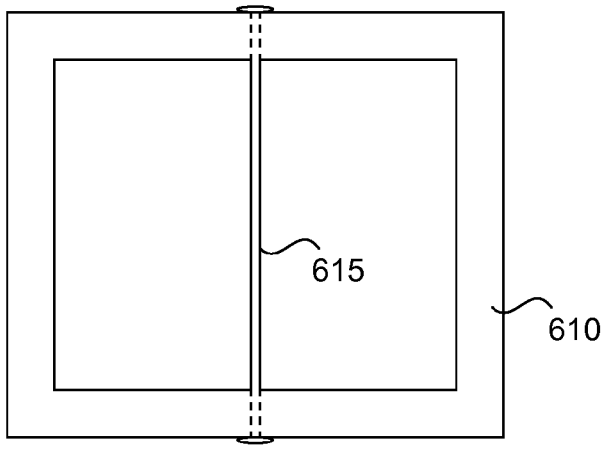
FIGS. 6*a*-6*d* are front views of sign systems having locking devices extending therethrough in accordance with embodiments of the present invention.
Figure 6B:
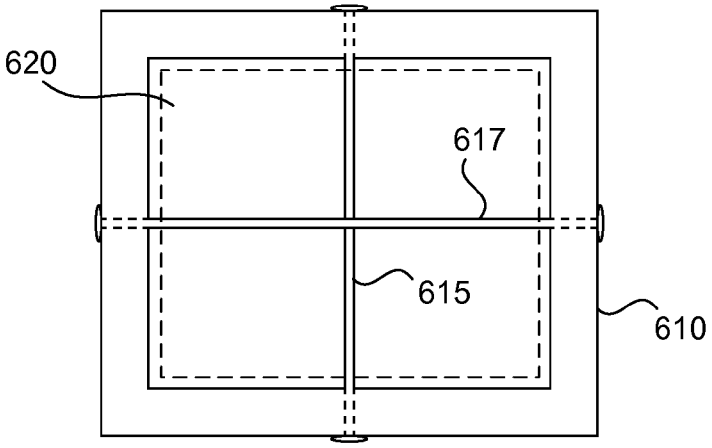
Figure 6C:
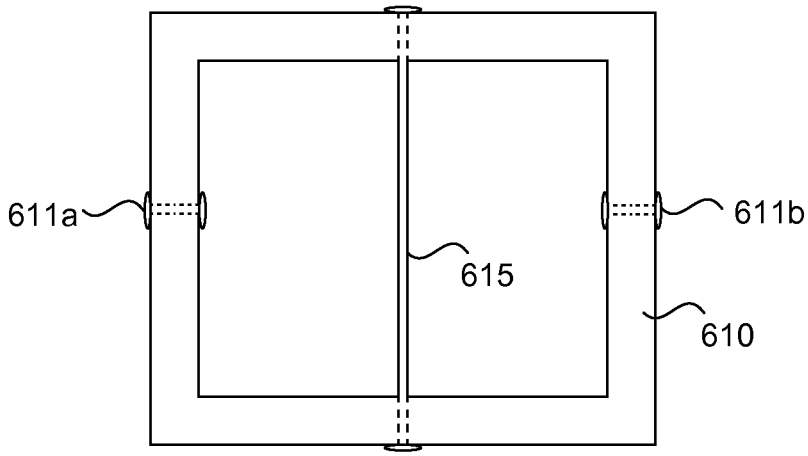
Figure 6D:
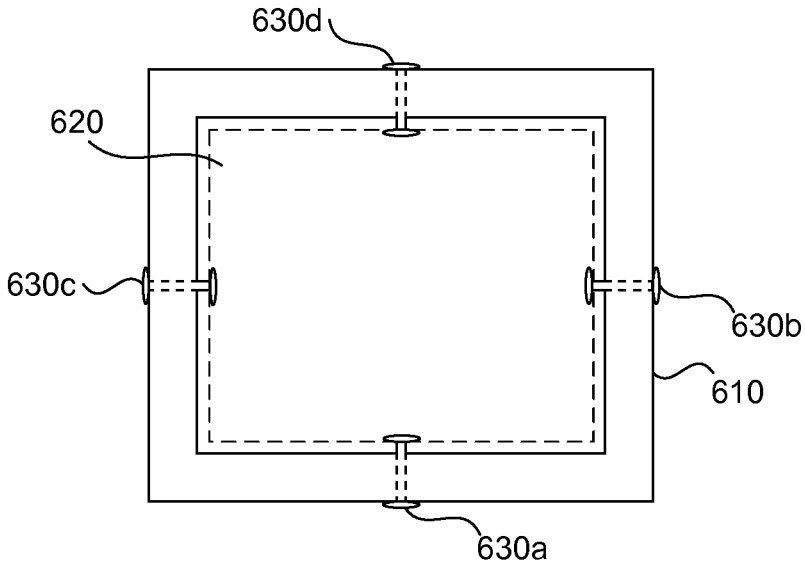

Referring to FIGS. 6*a*-6*b*, sign systems are illustrated in accordance with examples of the present technology. FIG. 6*a* illustrates an example where a locking bar 615 is inserted in one side of the frame 610 and coupled on the other side of the frame. As shown in FIG. 6*b*, a sign segment 620 can include an aperture through which the lock 615 is configured to at least partially extend to lock the sign segment within the frame, and wherein the lock extends through a first side of the frame 610, through the sign segment, and through a second side of the frame. The system of FIG. 6*b* further illustrates an example where the lock includes multiple locks 615, 617 oriented orthogonally to one another to lock the sign segment within the frame on multiple sides. An added feature of the use of one or more locks extending from one side of the frame to the other and through the sign segment is that the locks can act as supporting structures configured to provide support and stability to the sign system. FIG. 6*c* illustrates two smaller rods 611*a*-*b* that can be fastened through the frame and the edge of the sign to hold the sign in place along with the locking bar. These smaller rods can be screwed or welded in place FIG. 6*d* illustrates multiple small rods 630 *a*-*c* that can fasten the sign to frame.

Figure 7:
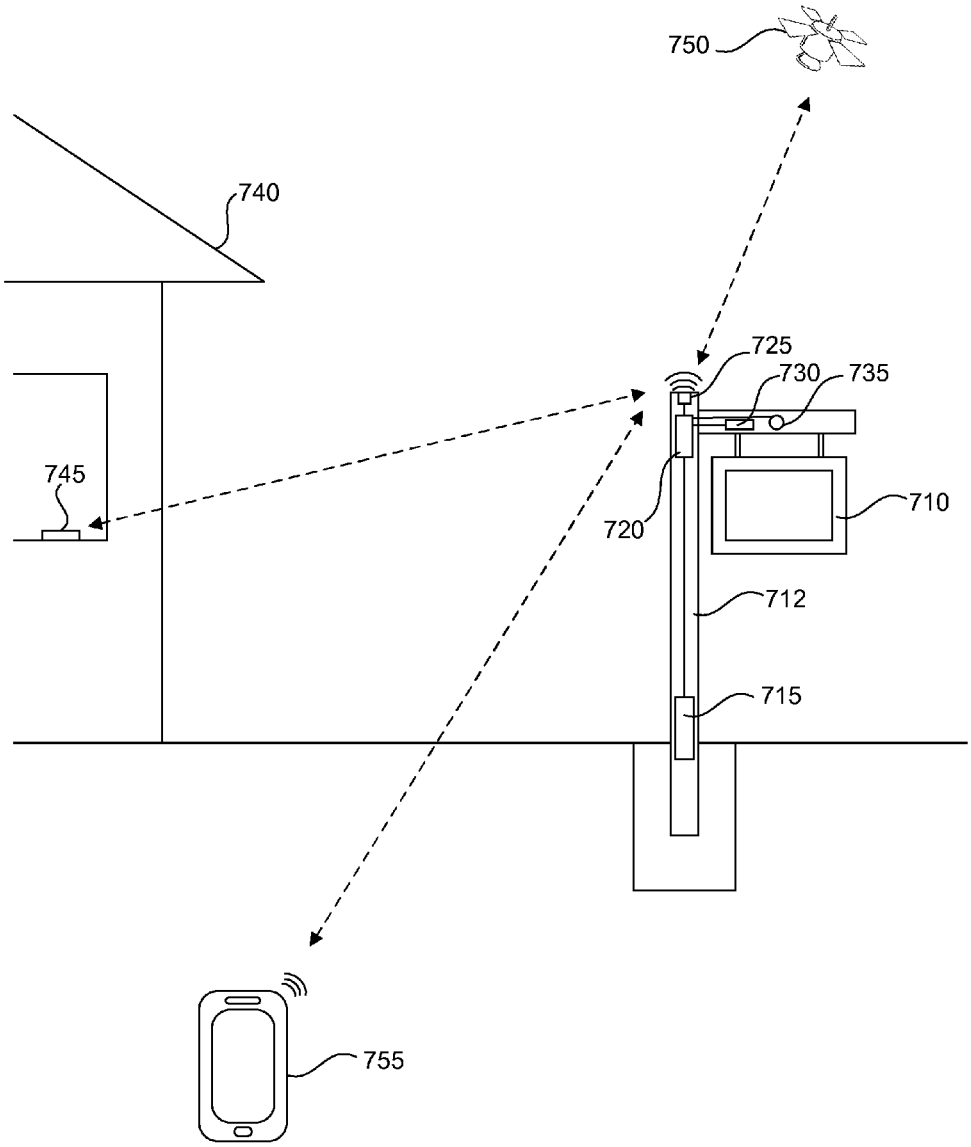
FIG. 7 illustrates a sign system including a security system in accordance with an embodiment of the present invention.

FIG. 7 illustrates a sign system in accordance with an example of the present technology. The sign system includes a frame 712 and a sign segment 710 configured to be supported by the frame. The sign system can include a security system (e.g., 735, 745) in communication with the frame and configured to detect a security breach in an area proximal to the frame. The sign system can include a transmitter 725 in the frame and configured to transmit a signal to a user when the security breach is detected.

The security system can be configured to detect a breach in security of the frame or the sign segment, such as if someone attempts to steal, dismantle, or perform some other unauthorized activity with respect to the frame or sign segment. The security system can alternately or in addition be configured to detect a breach in security of a house 740 proximal to the frame. Thus, in some examples, the security system may be at least partially located separately from the frame and sign segment, such as within a house at 745. For example, the security system can detect whether a window or door is opened, or any of a variety of other security breaches. When a breach in a house or other structure, or even a breach in an area near the sign but not in a structure, is detected, the security system can transmit information regarding the breach to the sign system. For example, an alert, location information, picture or video feed, etc. can be transmitted to the sign. A security system for the sign system can save a significant amount of money in sign and printing costs over conventional signs or sign systems, which are commonly stolen, destroyed, etc.

The security system can include, for example, sensors and transmitters near or on windows to detect movement near the window or of the window. Entry points to a structure can be monitored by camera and restricted by keycodes or the like. A camera feed can be fed through the sign system to the internet or can be stored locally at the sign system. A fence proximal to the sign system can have motion sensors, laser lights, cameras, talking alarms, or other security devices. Wall wiring in the structure can be pulsed in a supply box, with a control box having a power supply for pulsing of the wires, where a disruption of the pulse can indicate a breach of security. Any of a variety of other suitable security mechanisms can also be used.

In one example, a camera 735 can be supported by the frame and configured to capture an image of the area proximal to the frame to identify a source of the security breach. In another example, the transmitter can be configured to transmit a request to a satellite 750 to capture a satellite image of the area proximal to the frame. The sign system can further include a receiver 730 configured to receive the satellite image and a computer readable storage medium or processor 720 configured to store and/or process the satellite image.

Any images captured or received, and/or any alerts or alarms generated by the security system can be transmitted by the transmitter to a user computing device. For example, the user computing device can be a desktop, laptop, tablet, smartphone 755, or any other suitable computing device. The sign system can include a receiver supported by the frame and configured to receive an arm/disarm signal from a user computing device. The transmitter can in turn be configured to transmit the arm/disarm signal to the security system.

The sign system can be a smart system and can detect whether a person is authorized to be present or performing a particular activity using any of a variety of techniques, such as facial recognition, communication with a smart device carried by the person, and so forth. If the user is authorized, the sign system can deactivate the security system and will not transmit alerts for breaches of the security system.

The sign system can include a computer readable storage device 720 configured for storing data, such as for example, images, alerts, intrusions, authorized access to a property, a list of authorized users, computer readable instructions for performing any of the methods described herein for detection, processing, authorizing, transmitting/receiving, etc.

The sign system can include a power supply 715 for powering any of the included electronic devices.

Security information of or near the sign system in this embodiment can be sent from the property to the sign to a user or company managing the property and/or managing the sign. Information which can be collected, stored, and/or transmitted to the user can include any of a variety of types of information including, but not limited to: address or other property related information; wind, temperature, precipitation, or other weather related information; status of the power source; status of the sign; position of the sign (such as if lowered or otherwise protected for weather or other reasons); information relating to access to the property, and so forth. In one example, the sign system can be owned and leased by a security monitoring company.

In one example, the sign can be configured to broadcast a signal at least over a relatively short range via the transmitter 725 for use in marketing a property for sale. For example, when a realtor or prospective buyer is within a mile or a ½ mile of the property, a smart phone or other device can detect the signal being broadcast from the sign system to become informed of the presence of the property for sale. The signal can optionally include information about the property, including sale price, size, address, travel directions to the property, and so forth. In one aspect, a phone number can be stored in the sign system and the sign system can be configured to detect a wireless signal from a phone associated with the stored phone number when the phone is near the property. While the sign may not be configured to monitor a telephone conversation from the phone, the sign can use technology similar to cell phone towers to identify the phone. In another aspect, the sign can be in communication with cell phone towers to be informed of when the phone is near the sign. The sign system can receive triangulation information about the phone from the cell phone towers and can send information to the phone via the cell phone towers. For example, the sign system can cause the phone to beep or display an alert that the owner of the phone is near the sign system. Distance from the sign can be sent, directions to the sign can be sent, information about the property can be sent, and so forth.

The methods and systems of certain embodiments may be implemented in hardware, software, firmware, or combinations thereof. In one embodiment, the method can be executed by software or firmware that is stored in a memory and that is executed by a suitable instruction execution system. If implemented in hardware, as in an alternative embodiment, the method can be implemented with any suitable technology that is well known in the art.

The various engines, tools, or modules discussed herein may be, for example, software, firmware, commands, data files, programs, code, instructions, or the like, and may also include suitable mechanisms.

Reference throughout this specification to "one embodiment", "an embodiment", or "a specific embodiment" means that a particular feature, structure, or characteristic described in connection with the embodiment is included in at least one embodiment of the present invention. Thus, the appearances of the phrases "in one embodiment", "in an embodiment", or "in a specific embodiment" in various places throughout this specification are not necessarily all referring to the same embodiment. Furthermore, the particular features, structures, or characteristics may be combined in any suitable manner in one or more embodiments.

Other variations and modifications of the above-described embodiments and methods are possible in light of the foregoing disclosure. Further, at least some of the components of an embodiment of the invention may be implemented by using a programmed general purpose digital computer, by using application specific integrated circuits, programmable logic devices, or field programmable gate arrays, or by using a network of interconnected components and circuits. Connections may be wired, wireless, and the like.

It will also be appreciated that one or more of the elements depicted in the drawings/figures can also be implemented in a more separated or integrated manner, or even removed or rendered as inoperable in certain cases, as is useful in accordance with a particular application.

Also within the scope of an embodiment is the implementation of a program or code that can be stored in a machine-readable medium to permit a computer to perform any of the methods described above.

Additionally, the signal arrows in the Figures are considered as exemplary and are not limiting, unless otherwise specifically noted. Furthermore, the term "or" as used in this disclosure is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Various functions, names, or other parameters shown in the drawings and discussed in the text have been given particular names for purposes of identification. However, the functions, names, or other parameters are only provided as some possible examples to identify the functions, variables, or other parameters. Other function names, parameter names, etc. may be used to identify the functions, or parameters shown in the drawings and discussed in the text.

Furthermore, the described features, structures, or characteristics may be combined in any suitable manner in one or more embodiments. In the preceding description, numerous specific details were provided, such as examples of various configurations to provide a thorough understanding of embodiments of the described technology. One skilled in the relevant art will recognize, however, that the technology can be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements can be devised without departing from the spirit and scope of the described technology.

The invention claimed is:

1. A sign system comprising, a frame having a slot formed in a side thereof;

a sign segment sized and shaped to fit within the slot in the frame;

a lock on the frame configured to extend through at least a portion of the frame in a locked position to prevent the sign segment from moving out of the slot;

a security system in communication with the frame configured to detect a security breach in an area proximal to the frame; and a transmitter in the frame and configured to transmit a signal to a user when the security breach is detected;

wherein the slot enables the sign segment to slide vertically along the frame between the upper portion of the frame and a lower portion of the frame when the lock is unlocked; and wherein the secondary sign segment release for releasing a portion of the sign segment from the slot in the frame to enable rotation of the sign segment from a substantially vertical orientation to a substantially horizontal orientation.

2. A sign system as in claim 1, wherein the security system is configured to detect a breach in security of the frame or the sign segment, or of a house proximal to the frame, the security system being at least partially located within the house.

3. A sign system as in claim 1, further comprising a camera supported by the frame and configured to capture an image of the area proximal to the frame to identify a source of the security breach.

4. A sign system as in claim 1, further comprising a receiver supported by the frame and configured to receive an arm/disarm signal from a user computing device, the transmitter being configured to transmit the arm/disarm signal to the security system.

5. A sign system as in claim 1, wherein the sign segment includes an aperture through which the lock is configured to at least partially extend to lock the sign segment within the frame, and wherein the lock extends through a first side of the frame, through the sign segment, and through a second side of the frame.

6. A sign system as in claim 1, wherein the lock comprises a plurality of locks oriented orthogonally to one another to lock the sign segment within the frame on multiple sides and wherein the locks are supporting structures configured to provide support and stability to the frame.

7. A sign system comprising, a frame comprising a plurality of frame members and configured to support a sign segment;

a detector in the frame and in communication with the plurality of frame members and configured to detect a change in a configuration of the frame;

a transmitter supported by the frame and configured to transmit a signal to a user when changes in the configuration of the frame are detected; and a sensor supported by the frame and configured to detect wind blowing against at least one of the frame and the sign segment;

wherein the transmitter is further configured to transmit an alert to a user when a force of the wind is greater than a predetermined amount, as detected by the sensor, and wherein the frame comprises a protection mechanism for protecting the at least one of the frame and the sign segment from the wind with the force greater than the predetermined amount, wherein:

the protection mechanism comprises a sign segment release for releasing the sign segment from an upper portion of the frame;

the frame comprises a slot to enable the sign segment to slide vertically along the frame between the upper portion of the frame and a lower portion of the frame when the sign segment is released; and the sign system further comprises a secondary sign segment release for releasing a portion of the sign segment from the slot in the frame to enable rotation of the sign segment from a substantially vertical orientation to a substantially horizontal orientation.

8. A sign system as in claim 7, wherein:

the plurality of frame members are electrically coupled together and the change in the configuration of the frame detected by the detector comprises a disruption of an electrical connection between at least two of the plurality of frame members; or the plurality of frame members are in wireless communication with the detector and the change in the configuration of the frame detected by the detector comprises a disruption of the wireless communication of the detector with at least one of the plurality of frame members.

9. A sign system as in claim 7, wherein the detector comprises at least one of a global positioning system (GPS) device, a radio frequency device, and an accelerometer and is configured to detect movement of at least one of the plurality of frame members.

10. A sign system as in claim 7, wherein the detector comprises a camera and a processor, the camera being configured to identify a normal state of the plurality of frame members and a current state of the plurality of frame members, and the processor being configured to compare the normal state and the current state to determine whether there is a change in the configuration of the frame.

11. A sign system as in claim 7, wherein the protection mechanism comprises a hinge near a base of the frame for pivoting the frame between an upright position and a substantially horizontal position, the substantially horizontal position being substantially horizontal with a surface of a ground supporting the sign system.

12. A sign system as in claim 7, wherein the protection mechanism comprises at least one of a shield, cover, and enclosure, and the protection mechanism is at least one of manually operatable by a user, remotely activatable by a user via a computing device, and automatically activated when the alert is transmitted to the user.

13. A weather protected segmented sign system, comprising:

a frame having multiple slots formed in the frame;

a plurality of sign segments comprised of a substantially rigid plastic material, each sign segment configured to be vertically stackable within the frame and independently removable from the frame, wherein the frame is configured to hold the plurality of sign segments in a vertically stacked configuration, wherein the frame comprises a sign segment release for releasing the plurality of sign segments from an upper portion of the frame and a slot to enable the plurality of sign segments to slide vertically along the frame between the upper portion of the frame and a lower portion of the frame, and wherein the secondary sign segment release for releasing a portion of the sign segment from the slot in the frame to enable rotation of the sign segment from a substantially vertical orientation to a substantially horizontal orientation;

the plurality of sign segments each having:

an inner layer made of opaque vinyl and having a plurality of sides, the inner layer being configured to include graphics, photos, or alphanumeric messages on at least one of the plurality of sides, wherein the inner layer is held in a slot in the frame, and one or more substantially transparent weather protecting layers, each attachable to at least one of the plurality of sides of the inner layer, the one or more weather protecting layers configured to enable each sign segment to be essentially undamaged by weathering effects for a period of years, and each of the one or more weather protecting layers further configured to accept graphical and alphanumeric images carried upon an interior face, wherein the substantially transparent weather protecting layers are located in slots formed in the frame and the substantially transparent weather protecting layers cover the inner layer;

an accessories receiver configured to receive accessories to the segmented sign system; and an accessories that can be attached to the accessories receiver, the accessories selected from the group consisting of: lights, additional sign holders, motors, flags, decorative knobs, brochure holders, a lock box, and electronic components.

14. A segmented sign system as in claim 13, wherein the frame is substantially covered with a powder coating to minimize weathering to the frame and wherein the one or more weather protecting layers are comprised of a substantially transparent material selected from the group consisting of acrylic, polyester film, glass, Biaxially-oriented polyethylene terephthalate (boPET) polyester) and Polymethyl methacrylate.

15. A segmented sign system as in claim 13, wherein:

each of the sign segments in the sign have information printed on both sides of a layer of the sign segment and each of the plurality of sign segments is removable in order to allow a sign segment to be replaced with a different sign segment;

each of the plurality of sign segments have a substantially equal size, the segmented sign system further comprising at least one additional sign segment having a different size than the plurality of sign segments; and one or more of the plurality of sign segments are glued or fastened together to form a single unit, wherein a portion of sign segments are sealed and the remainder are glued or fastened in the frame.

16. A segmented sign system as in claim 13, further comprising a sign placement attachment coupled to the frame and configured to allow a person to place their foot in the sign placement attachment and drive the segmented sign system into a piece of ground a sufficient distance to support the segmented sign system.

17. A segmented sign system as in claim 13, wherein at least one of the plurality of sign segments has pre-printed information that is selected by a user and at least one of the plurality of sign segments has customizable data that is added by the user after the segmented sign system is manufactured, and wherein the segments with pre-printed information include stable data that does not change in the sign and the remaining segments contain non-stable data to be customized in the sign.

18. A segmented sign system as in claim 13, wherein one or more of the plurality of sign segments comprise plastic material having magnetic material impregnated therein to allow magnets to be attached to the one or more sign segments; and wherein the one or more weather protecting layers further comprise a plurality of weather protecting layers that have messaging on one or more of the layers.

* * * * *